US010637120B2

(12) United States Patent
Altan

(10) Patent No.: US 10,637,120 B2
(45) Date of Patent: Apr. 28, 2020

(54) HIGH AVERAGE RF POWER RESISTANT FERRITE PHASE SHIFTER

(71) Applicant: ASELSAN ELEKTRONIK SANAYI VE TICARET ANONIM SIRKETI, Ankara (TR)

(72) Inventor: Hakki Ilhan Altan, Ankara (TR)

(73) Assignee: ASELSAN ELEKTRONIK SANAYI VE TICARET ANONIM SIRKETI, Ankara (TR)

( * ) Notice: Subject to any disclaimer, the term of this patent is extended or adjusted under 35 U.S.C. 154(b) by 0 days.

(21) Appl. No.: 16/244,130

(22) Filed: Jan. 10, 2019

(65) Prior Publication Data

US 2019/0214697 A1 Jul. 11, 2019

(30) Foreign Application Priority Data

Jan. 11, 2018 (TR) ..... a 2018 00404

(51) Int. Cl.
*H01P 1/195* (2006.01)
*H01P 1/30* (2006.01)

(52) U.S. Cl.
CPC ..... *H01P 1/195* (2013.01); *H01P 1/30* (2013.01)

(58) Field of Classification Search
CPC .. H01P 1/195; H01P 1/182; H01P 1/18; H01P 1/30
USPC ..... 333/24.1, 248, 157, 156, 158
See application file for complete search history.

(56) References Cited

U.S. PATENT DOCUMENTS 3,524,152 A 8/1970 Agrios et al.
4,884,045 A * 11/1989 Alverson ..... H01P 1/19 333/158
5,812,032 A * 9/1998 Stitzer ..... H01P 5/1007 333/158
5,828,271 A * 10/1998 Stitzer ..... H01P 1/195 333/24.1

* cited by examiner

*Primary Examiner* — Stephen E. Jones
(74) *Attorney, Agent, or Firm* — Bayramoglu Law Offices LLC

(57) ABSTRACT

A phase shifter capable of withstanding very high average RF power, which enables directing of the beam in radar systems, it includes a waveguide, a ferrite toroid, composite dielectric plate including a dielectric plate in high thermal conductivity and a dielectric plate with the high dielectric constant, which increases the amount of phase shift per the unit length by directing the electric field and the transfer of heat generated on the ferrite toroids to the waveguide, a twin-toroid ferrite-dielectric structure including a combination of ferrite toroids and composite dielectric plates.

3 Claims, 2 Drawing Sheets

HIGH AVERAGE RF POWER RESISTANT FERRITE PHASE SHIFTER

CROSS REFERENCE TO RELATED APPLICATIONS

This application is based upon and claims priority to Turkish Patent Application No. 2018/00404, filed on Jan. 11, 2018, the entire contents of which are incorporated herein by reference.

TECHNICAL FIELD

The invention relates to a ferrite phase shifter capable of withstanding very high average RF power, which provides beam directing in radar systems.

The invention in particular relates to a twin-toroid phase shifter which provides beam directing in radar systems and can withstand high average RF power.

BACKGROUND

Today, the reduction of the phase shift due to the decrease in saturation magnetization can be corrected by increasing the size of the twin-toroid ferrite-dielectric structure. However, this method is not appropriate because it increases the total phase shifter size and the loss of interference.

In the prior art, low dielectric constants of dielectric materials with high thermal conductivity prevent their use in phase shifters.

The literature search conducted in the prior art reveals an application entitled as "NON-RECIPROCAL WAVEGUIDE PHASE SHIFTER HAVING SIDE-BY-SIDE FERRITE TOROIDS" with reference number U.S. Pat. No. 3,524,152 (A). In this application, an insulating plate consisting of single type dielectrics is used between ferrite toroids. The dielectric constant of this material must be high (>15) to increase the phase shift that can be obtained from the unit size. However, since the dielectric constant of high dielectric materials has low thermal conductivity (<10 W/mK), it is not possible to transport the heat generated in the center of the structure to the waveguide and therefore temperature rise occurs in the center of the phase shifter. The magnetic saturation magnetization value of the ferrite materials (4 $\pi$Ms) decreases as the temperature increases and this leads to a decrease in the phase shift performance.

As a result, due to the above-mentioned drawbacks and the inadequacy of the existing solutions, an improvement in the technical field has been required.

SUMMARY

The invention is inspired by the existing circumstances and aims to solve the above-mentioned drawbacks.

The main purpose of the invention is to ensure that the heat generated by using two different dielectric materials in the composite structure of dielectric plates in sandwich structure on ferrite material is transferred to the waveguide via the high conductivity dielectric material adhered to the ferrite material surface. In this way, the temperature increase in the center of the ferrite material is prevented.

Another purpose of the invention is to increase the amount of phase shift obtained from the unit length by directing the electric field with the high dielectric constant dielectric material in the center of the composite dielectric plate. This enables the realization of a compact and low-loss phase shift circuit.

In order to fulfill the above-mentioned purposes, the invention is a phase shifter capable of withstanding very high average RF power, which enables directing of the beam in radar systems, comprising a waveguide, a ferrite toroid, a dielectric plate in high thermal conductivity providing heat transfer and the high dielectric constant, which increases the amount of phase shift per the unit length by directing the electric field.

The structural and characteristic features and all advantages of the invention outlined in the drawings below and in the detailed description made by referring these figures will be understood clearly, therefore the evaluation should be made by taking these figures and detailed explanation into consideration.

REFERENCE NUMBERS

1. Phase Shifter
2. Waveguide
3. Twin-Toroid Ferrite-Dielectric Structure
4. Ferrite Toroid
5. Composite Dielectric Plate
6. Dielectric Plate with High Thermal Conductivity
7. Dielectric Plate with High Dielectric Constant

DETAILED DESCRIPTION OF THE EMBODIMENTS

In this detailed description, the preferred structures of the high average RF power resistant ferrite phase shifter (1) of the invention are described only for a better understanding of the subject.

Figure 1:
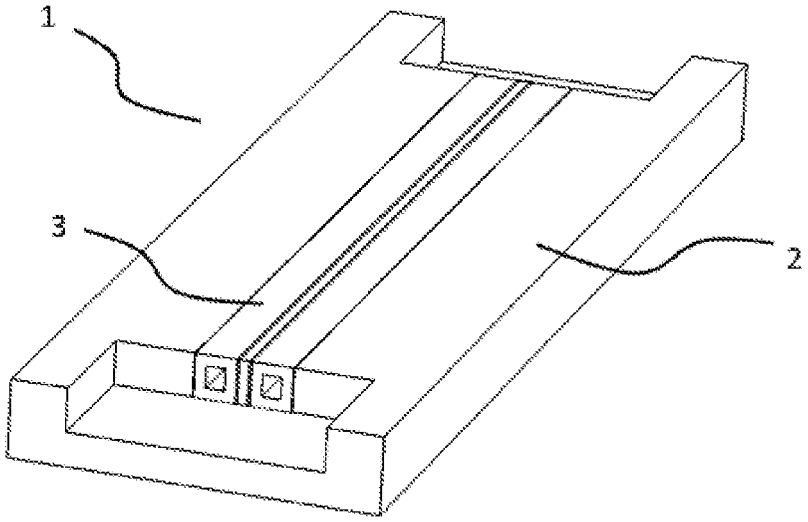
FIG. 1 is a view of the twin-toroidal phase shifter of the invention.
Figure 2:
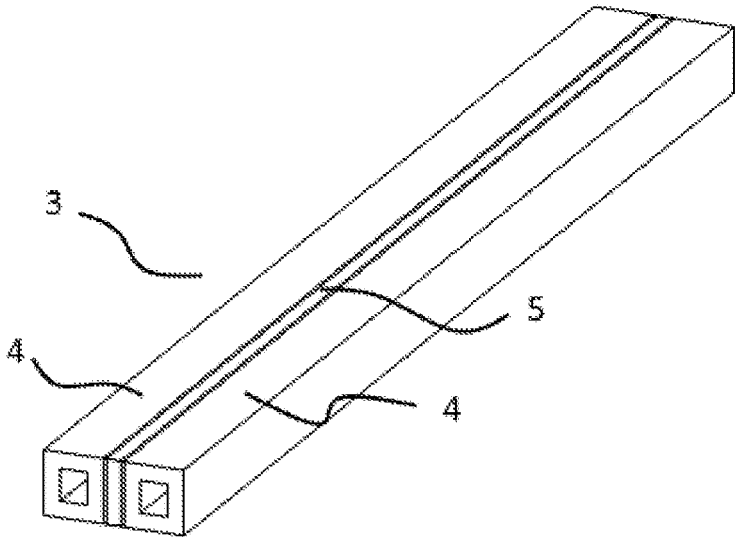
FIG. 2 is a view of the twin-toroidal ferrite-dielectric structure.

In FIG. 1 and FIG. 2, the phase shifter (1), which provides guidance to beams in radar systems, comprises basically the waveguide (2), twin-toroid ferrite-dielectric structure (3), ferrite toroids (4), and composite dielectric plate (5) are seen.

In the preferred embodiment of the invention of FIG. 1, the phase shifter (1) comprises of a combination of the waveguide (2) and the twin-toroid ferrite-dielectric structure (3).

It consists of a combination of the twin-toroid ferrite-dielectric structure (3) shown in FIG. 2.

Figure 3:
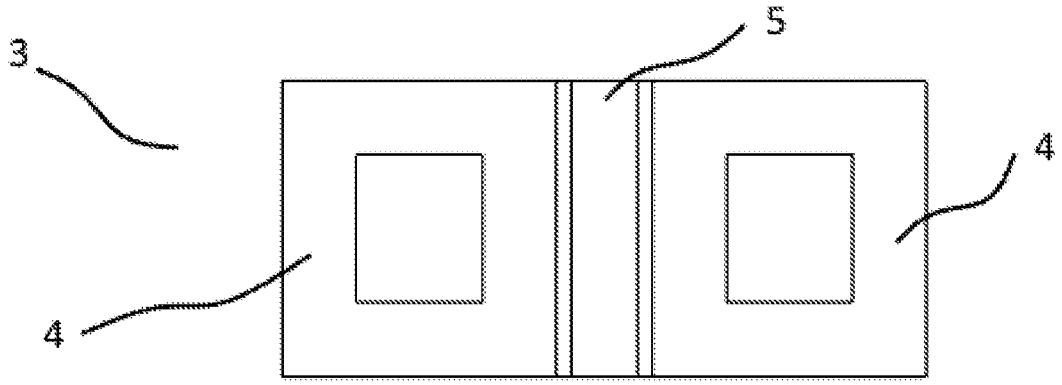
FIG. 3 is a view of the twin-toroidal ferrite-dielectric structure.
Figure 4:
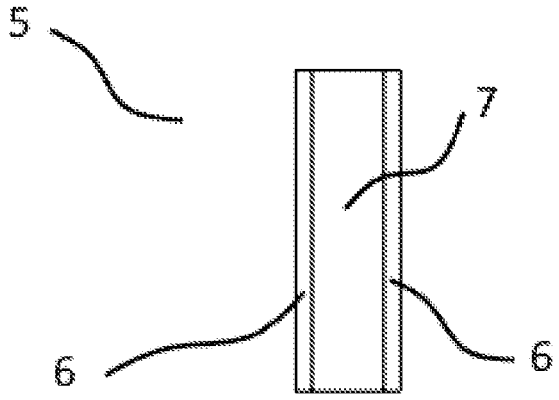
FIG. 4 is a view of a composite dielectric plate.

The composite dielectric plate (5) shown in FIG. 3 consists of a combination of a dielectric plate with high thermal conductivity (6) and a dielectric plate with high dielectric constant (7).

In the preferred embodiment of the invention, a high RF magnetic field must be created on the ferrite toroids (4) to reduce the size of the phase shifter (1) and to reduce its loss. Therefore, the dielectric constant of the dielectric plate used must be high, such as the dielectric plate with high dielectric constant (7). When the dielectric plate with high thermal conductivity (6) and a dielectric plate with high dielectric constant (7) forming the composite dielectric plate (5) are combined, the effective dielectric constant and the effective thermal conductivity of this composite dielectric plate (5)

are high. In this way, the phase shifter (1) can be realized in smaller size and operated under higher power.

Operating Principle of the Invention;

The use of the composite dielectric plate (5) formed by combining the dielectric plate with high dielectric constant (7) and dielectric plate with the high thermal conductivity (6) is to ensure that the heat generated on the ferrite toroids (4) is carried to the waveguide (2). In this way, the temperature increase in the center of the ferrite toroid (4) is prevented.

In the center of the composite dielectric plate (5), a dielectric plate with high dielectric constant (7) directs the electric field to increase the amount of phase shift obtained per the unit length. This enables the realization of a compact and low-loss phase shift (1) circuit.

What is claimed is:

1. A ferrite phase shifter capable of withstanding very high average RF power, which provides beam directing in radar systems, comprising:

a waveguide;

a ferrite toroid;

a composite dielectric plate for transporting the heat generated on the ferrite toroid to the waveguide, wherein, the composite dielectric plate comprises a combination of a dielectric plate with high thermal conductivity and a dielectric plate with high dielectric constant to increase an amount of phase shift obtained from a unit length by directing the electric field; and a twin-toroid ferrite-dielectric structure comprising a combination of the ferrite toroid and the composite dielectric plate.

2. The ferrite phase shifter according to claim 1, wherein, the twin-toroid structure consists of the composite dielectric plate sandwiched between a first ferrite toroid and a second ferrite toroid.

3. The ferrite phase shifter according to claim 1, wherein, the composite dielectric plate comprises the dielectric plate with high dielectric constant sandwiched between two dielectric plates with high thermal conductivity.

* * * * *